US006425843B1

(12) United States Patent
Storfer et al.

(10) Patent No.: US 6,425,843 B1
(45) Date of Patent: Jul. 30, 2002

(54) APPARATUS FOR STRETCHING THE CALF MUSCLES

(76) Inventors: Leesa Storfer, 2904 1/2 Grand Canal Ct., Venice, CA (US) 90291; James Gisondo, 937 Second St., Apartment 5, Santa Monica, CA (US) 90403

( * ) Notice: Subject to any disclaimer, the term of this patent is extended or adjusted under 35 U.S.C. 154(b) by 0 days.

(21) Appl. No.: 09/057,037

(22) Filed: Apr. 8, 1998

(51) Int. Cl.[7] ..... A63B 23/04; A63B 21/062

(52) U.S. Cl. ..... 482/79; 482/96; 482/137; 482/907; 482/100

(58) Field of Search ..... 482/137, 52, 79, 482/34, 142, 36, 907, 145, 91, 26, 35, 25, 97, 96, 100; 601/34, 35, 27, 28; 74/564; 472/127; 606/237

(56) References Cited

U.S. PATENT DOCUMENTS

| | | | | | |
|---|---|---|---|---|---|
| 971,003 | A | * | 9/1910 | Gilbride | 472/127 |
| 1,664,664 | A | * | 4/1928 | Crum | |
| 2,082,829 | A | * | 6/1937 | Gerlofson | 606/237 |
| 2,175,197 | A | * | 10/1939 | Kent, Jr. | 472/127 |
| 2,638,088 | A | * | 5/1953 | Johnson | |
| 3,271,028 | A | * | 9/1966 | Albin | 482/142 |
| D208,403 | S | * | 8/1967 | Bisanar | 74/564 |
| 3,379,437 | A | * | 4/1968 | Warner | 472/127 |
| 3,472,508 | A | | 10/1969 | Baker et al. | |
| 3,521,881 | A | * | 7/1970 | Schaevitz | |
| 3,740,033 | A | | 6/1973 | Kamp | |
| 3,845,952 | A | * | 11/1974 | McKinney | 472/127 |
| 3,887,179 | A | * | 6/1975 | Klepper et al. | 472/127 |
| 4,105,201 | A | * | 8/1978 | L'Ecuyer | |
| 4,253,661 | A | * | 3/1981 | Russell | |
| 4,281,830 | A | * | 8/1981 | Rehbein | 472/127 |
| D276,062 | S | | 10/1984 | Dennis | |
| 4,693,470 | A | * | 9/1987 | Ogawa | 482/907 |
| 4,927,136 | A | * | 5/1990 | Leask | 482/52 |
| 5,158,512 | A | * | 10/1992 | Irwin | 482/52 |
| 5,226,865 | A | * | 7/1993 | Chin | 482/52 |
| D338,933 | S | | 8/1993 | Nelly | |
| 5,242,342 | A | * | 9/1993 | Silverman | 482/79 |
| 5,284,465 | A | | 2/1994 | Homan, Jr. | |
| 5,352,166 | A | * | 10/1994 | Chang | 482/52 |
| 5,529,558 | A | * | 6/1996 | Koenig | 482/97 |
| 5,558,606 | A | * | 9/1996 | Poncini | 482/907 |
| 5,584,786 | A | * | 12/1996 | Almeda | 482/142 |
| 5,643,164 | A | | 7/1997 | Teff | |
| 5,743,831 | A | * | 4/1998 | Jakich | 482/52 |
| 5,769,759 | A | * | 6/1998 | Alter et al. | 482/54 |
| 5,820,520 | A | * | 10/1998 | Sieber | 482/34 |

* cited by examiner

*Primary Examiner*—Jerome W. Donnelly
*Assistant Examiner*—Victor Hwang
(74) *Attorney, Agent, or Firm*—Pennie & Edmonds LLP

(57) ABSTRACT

An apparatus for carrying out flexion exercises of the calf muscles is disclosed. The present invention provides a calf and foot stretching apparatus wherein the ball, the arch, the plantar fascitis and the heel of the foot conform to a convex curve of a foot plate with a slip resistant surface. While providing for effective stretching, the device provides for performing stretching and exercising in a safe, controlled and comfortable manner due to the design of the apparatus. The curved foot plate is firmly attached to a sturdy and stable support structure that may have means for attaching to a floor. Furthermore, so as to assist in keeping one's balance, the apparatus may have a vertical bar extending from the support structure to a height sufficient for one to hold onto while exercising.

20 Claims, 3 Drawing Sheets

APPARATUS FOR STRETCHING THE CALF MUSCLES

FIELD OF THE INVENTION

The present invention relates to exercise equipment in general and to exercise equipment for the heel flexors, toe flexors and calf muscles in particular.

BACKGROUND OF THE INVENTION

It is generally well known that stretching of the muscles prior to participation in athletics helps to increase performance and reduce the risk of injury. Furthermore, although not as widely well known, it is important not to over stretch. As many forms of athletics, as well as normal daily life, involve the use of the legs, it is important that the various leg muscles be properly stretched. Particularly important are the calf muscles.

In stretching the calf muscles, it is important to understand that not only are the muscles being stretched, but so is the Achilles tendon. The Achilles tendon attaches to the calf muscle and to the heel bone (calcaneus). The calf muscles and the muscles along the shin are needed to protect against shock in various exercises involving the legs. In athletics, the Achilles tendon bears forces up to six times that of a persons weight. If not stretched properly or if overused, the Achilles tendon may become injured to the point of rupturing.

As it pertains to the calf muscles and the Achilles tendon in particular, the best stretch is one done slowly and with proper support. If not done carefully, over stretching may result and may easily damage the Achilles tendon. Two generally used methods of stretching the calf muscles can be particularly dangerous: (1) standing on a step with the heel of the foot hanging off and then dropping down to stretch the calf muscle; and, (2) using a towel to pull the foot up to stretch the calf muscle. In these methods, the muscles and tendons may be stretched past the point in which they will have to move. In fact, by over stretching the muscles, the muscle fibers are attempting to contract because of the length they have reached. These types of stretches may over stretch the calf and Achilles tendon. Proper stretching should be done slowly and carefully.

Also important in considering stretching and the dangers of over stretching are the biomechanics of the bones involved. of particular interest is the subtalar joint that is comprised of the talus and calcaneus. Supination and pronation occur at this joint in a complex triplanar, multiphasic action. The normal range of motion of the subtalar joint is approximately 30 degrees where two-thirds of this motion is inversion and one-third is eversion from its neutral position. A primary determinant of normal gait is adequate dorsiflexion at the ankle so that in order for normal gait to occur, there should be at least 10 degrees of dorsiflexion available. Thus, proper stretching can assure this amount of dorsiflexion. Furthermore, proper support of the various bones involved, helps to avoid injury to the bones while improving range of motion.

A Many types of exercise equipment use a step-type apparatus for stretching the calves and for performing calf strengthening exercises. As discussed, this type of apparatus is not effective at providing for proper stretching and support of the muscles, tendons and bones involved. Still other types of stretching devices are made in such a way to provide for a rounded surface to come in contact with the floor. These types of devices are very unstable and often cause injuries.

SUMMARY OF THE INVENTION

The apparatus of the present invention provides a calf and foot stretching apparatus wherein the ball, the arch, the plantar fascitis and the heel of the foot conform to a convex curve of a foot plate with a slip resistant surface. The apparatus allows one to stretch both feet simultaneously or one foot at a time, whichever is desired by the user. While providing for effective stretching, the device provides for performing stretching and exercising in a safe, controlled and comfortable manner due to the design of the apparatus. The curved foot plate is firmly attached to a sturdy and stable support structure that may have means for attaching to a floor. Furthermore, so as to assist in keeping one's balance, the apparatus may have a vertical bar extending from the support structure to a height sufficient for one to hold onto while exercising. To further assist in providing assistance in keeping one's balance, the vertical bar may have perpendicularly attached handle bars so as to provide a comfortable grip.

The apparatus of the present invention may also be made in a two-user version wherein the apparatus is made up of a single or double convex steel foot plates covered with slip resistant surfaces. These curved plates are attached to two steel supports with tab attachments that secure to a floor. The two sides are then attached by a horizontal steel bar from which a steel vertical post extends upward branching out to two sets of rubber gripped handlebars. The vertical post is multi-functional as it has round posts extending perpendicularly to the post on either side to be used as weight plate holders, if so desired.

The stretching of the Achilles tendon, foot and calf muscles (gastrocnemius, soleus, tibialis posterior, peroneus longus and peroneus brevis) is performed by positioning oneself on top of the curve while holding onto the handrails for support and slowly lowering one's heels along the curve of the foot plate. The stretching motion supports the ball the arch and the heel of the foot. The range of motion of the stretch will be determined by the user's flexibility. As ones flexibility increases, one can step down lower along the arch to allow for a fuller stretch.

It is thus an object of the present invention to provide an exercise and stretching apparatus for the stretching of the calf muscles including the gastrocnemius, soleus, tibialis posterior, peroneus longus or peroneus brevis.

It is a further object of the present invention to provide an exercise and stretching apparatus for the stretching of the calf muscles that limits the motion so as to prevent the over stretching of the calf muscles and the various tendons involved including the Achilles tendon.

It is a further object of the present invention to provide an exercise and stretching apparatus for the stretching of the calf muscles that provides full support of the ankle and foot bones while not overexerting same by attempting to stretch beyond a normal range of motion.

It is a further object of the present invention to provide an exercise and stretching apparatus for the stretching of the calf muscles that provides a balance assisting means that extends from the base of the apparatus.

It is a further object of the present invention to provide an exercise and stretching apparatus for the stretching of the calf muscles that may be used by more than one person at the same time.

BRIEF DESCRIPTION OF THE DRAWINGS

Further characteristics and advantages of the apparatus according to the present invention will become more apparent in the following description of several of its embodiments, given as examples and not limitative, with reference to the attached drawings in which.

DESCRIPTION OF THE PREFERRED EMBODIMENT

Figure 1:
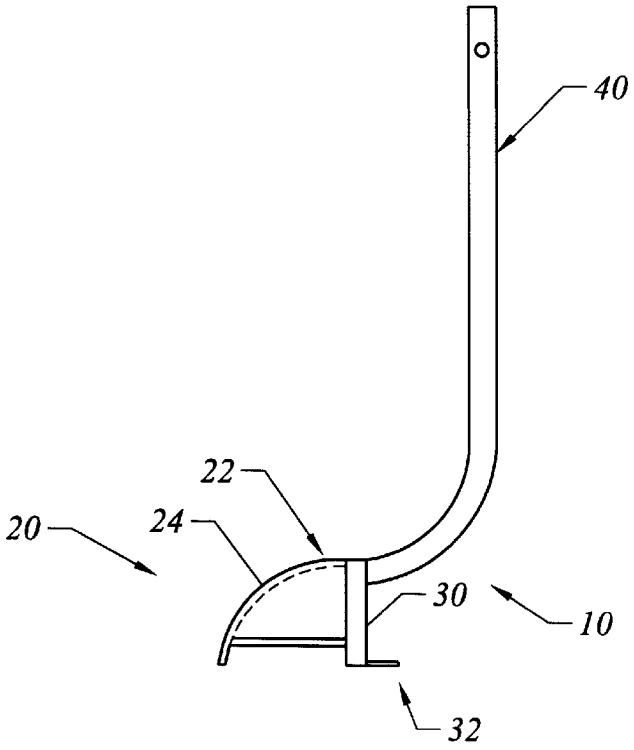
FIG. 1 is a side view of a single-user embodiment of the present invention.
Figure 2:
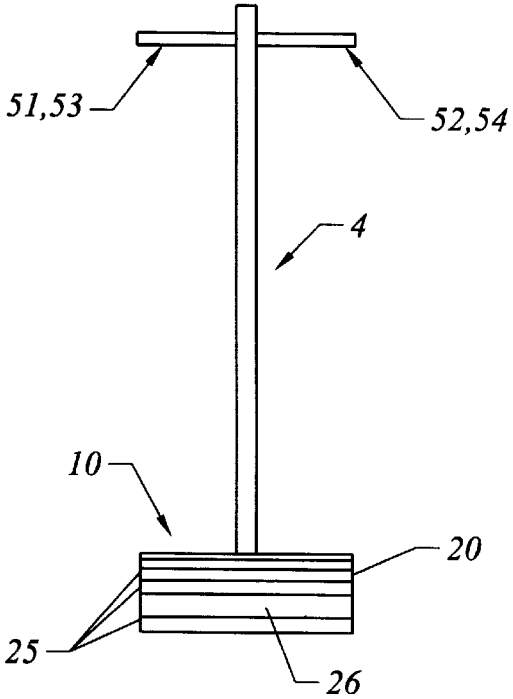
FIG. 2 is a front view of a single-user embodiment of the present invention.

Referring to FIGS. 1 and 2, the apparatus of the present invention may be made in a single-user version. The exercise apparatus 10 has as its main components the curved foot plate 20, the support structure 30. To supplement the invention, vertical bar 40 and handles 51 and 52 may be added as will be described below. The embodiment of the present invention as illustrated in FIGS. 1 and 2 is shown as would be used on a floor surface. The present invention provides for varying degrees of stretching and exercising by means of curved foot plate 20. Curved foot plate 20 is of a radius that provides varying degrees of stretching and exercising by placing one's foot at different points on the curved plate. For instance, one with limited range of motion or one just starting an exercise regimen would place their foot high up on the curved plate as indicated by point 22 on FIG. 1. In this way, the user's foot is well supported, while the user is not allowed to over stretch his muscles, tendons and bones. Conversely, one in good health and with good flexibility may place their foot at point 24. In this way, the user's foot is well supported while the user is allowed to stretch with more range of motion. So as to assist the user, curved foot plate may have appropriate markings 25 denoting varying levels of difficulty where, for example, point 22 may have a relative difficulty of 1 and point 22 may have a relative difficulty of 10. These relative difficulties are provided only as an example and not as a limitative.

In providing varying degrees of difficulty, it is also important to provide good support of the various parts of the feet including the toes, the balls of the feet, the arches and the heels. While a step-type stretching device is completely inadequate for this purpose as it provide concentrated points of high stress, it has been found that a curved surface such as curved foot plate 20 is provides very good support of the various parts of the foot. With a curved surface of appropriate radius of curvature, varying degrees of difficulty in stretching may also be provided while having a built-in limitation that avoids over stretching. Because of the curved surface, the user's foot comes in contact with the curved surface before being able to over stretch.

Curved foot plate 20 may be made of high strength steel so as to provide a strong surface upon which to place one's foot. Furthermore, it has been found that to achieve the advantages described above, the radius of curvature should be between about 5 and 36 inches, preferably 14 to 16 inches and most preferably approximately 15.25 inches. An approximate radius of curvature of 15.25 inches provides for support to a wide range of foot sizes. Where the apparatus is made for a particular population, the radius of curvature may be adjusted. For example, younger athletes or women with their smaller foot sizes may find a smaller radius of curvature appropriate. Conversely, professional basketball players with their larger foot sizes may find a larger radius of curvature appropriate.

Curved foot plate 20, because of the material from which it is made, may provide a slippery surface. Because a slippery surface is not appropriate in exercising or stretching, curved foot plate 20 may have a slip resistant surface 26. Slip resistant surface 26 may be a rubber non-slip surface or a sufficiently scuffed metal surface. Markings 25 may also be place on slip resistant surface 26 as may be appropriate.

Curved foot plate 20 is held in place by support structure 30. Support structure 30 may be made of the same material as curved foot plate 20 such as high strength steel. Where a metal is used, support structure 30 may be attached to curved foot plate 20 by welding the components together. Alternatively, the components may be bolted together in an appropriate way. Support structure 20 may have floor attaching means 32 for permanently affixing exercise apparatus 10 to a floor.

Vertical bar 40 and handles 51 and 52 provide a means by which a user may assist his balance. By grasping handles 51 and 52, a user may prevent himself from falling over. Furthermore, because balance is supplemented, the user may provide full attention to the exercise at hand, namely stretching or exercising the calf and foot. By being fully attentive to the exercise, a user may have a more effective exercise while also avoiding injury.

Vertical bar 40 is attached to support structure 30. Where a high strength steel or other metal is used, welding of these components may be appropriate. Furthermore, bolting the components together may be appropriate. It has been found that a length of 3.5 feet is appropriate for vertical bar 40. Handles 51 and 52 are attached to vertical bar 40 at a height of approximately 3.25 feet. Handles 51 and 52 may be covered with handle grips 53 and 54. Plastic or rubber may be appropriate materials to use for making handle grips 53 and 54.

Figure 3:
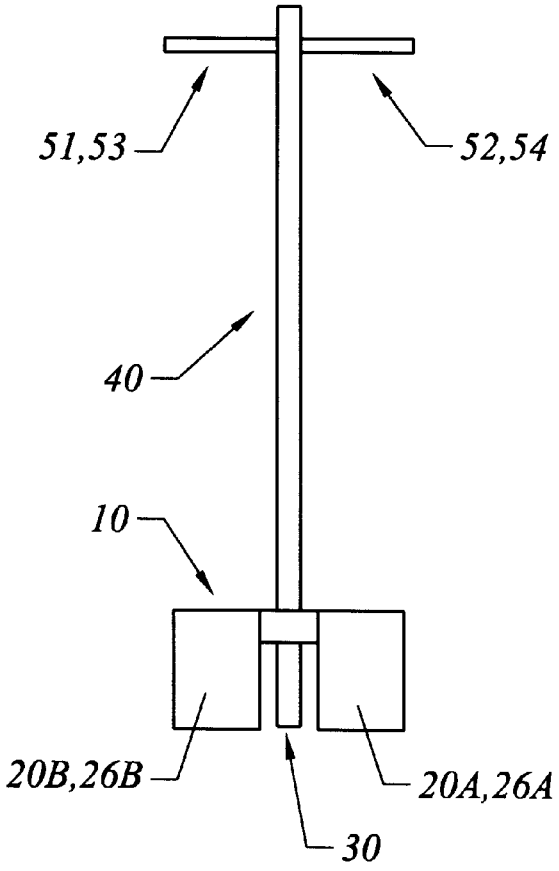
FIG. 3 is a front view of a single-user embodiment of the present invention with separate curved foot plates for the right and left feet.

FIGS. 1 and 2 illustrate the use of a continuous surface for providing curved foot plate 20, however, FIG. 3 illustrates another embodiment of the present invention. The embodiment as illustrated in FIG. 3 provides for two distinct curved foot plates 20A and 20B whereby each provides an exercise surface for the right and left feet, respectively. Curved foot plates 20A and 20B may have slip resistant surfaces 26A and 26B as described previously. Furthermore, support structure 30, vertical bar 40 and handles 51 and 52 are as described previously. Curved foot plates 20A and 20B may have a width of approximately 9 inches so as to provide full support of each foot.

Figure 4:
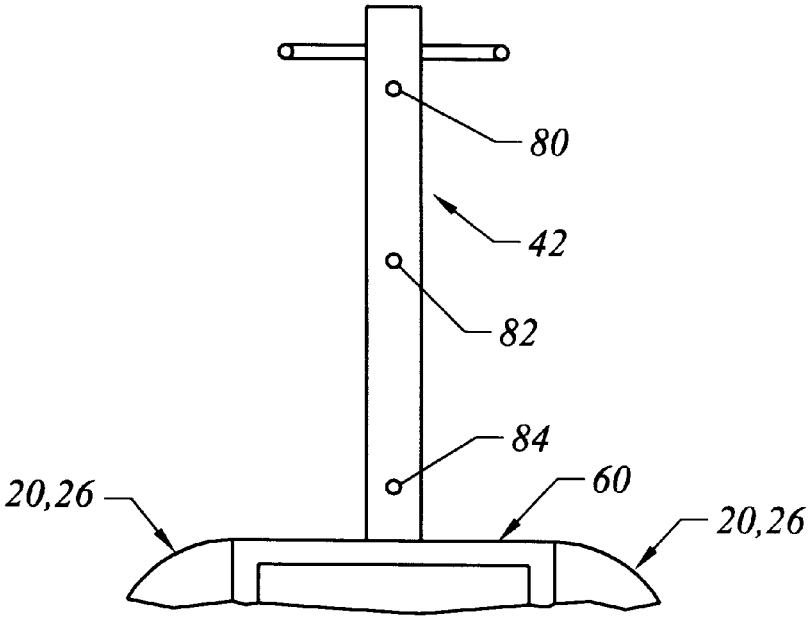
FIG. 4 is a side view of a two-user embodiment of the present invention.

FIG. 4 provides a further embodiment of the present invention wherein two users may simultaneously have means for exercising in a similar manner. Note that FIG. 3 is symmetric about Plane A. In FIG. 4, two curved foot plates 20 are shown with associated slip resistant surfaces 26 and support structures 30. Support structures 30 are joined together by cross-member 60. Cross-member 60 should be of sufficient length to separate two users that may exercise simultaneously. It has been found that a length of approximately 30 inches is appropriate for the cross-member 60. Cross-member 60 may be joined to support structures 30 by welding or bolting as may be appropriate in a particular application. Vertical bar 42 is attached to cross-member 60 by appropriate means and extends upward for a length of approximately 3.5 feet. Vertical bar 42 has handle extensions 70 attached which are in turn attached to handles 55 and 56. It has been found that handles 55 and 56 may be affixed at a height of approximately 3.25 feet and may further be covered with handle grips 53 and 54. As space is very important in a gymnasium environment, vertical bar 42 may have attached plate holders 80, 82 and 84. Plate holder 80, 82 and 84 may be used for storing iron weight plates or similar objects.

Figure 5:
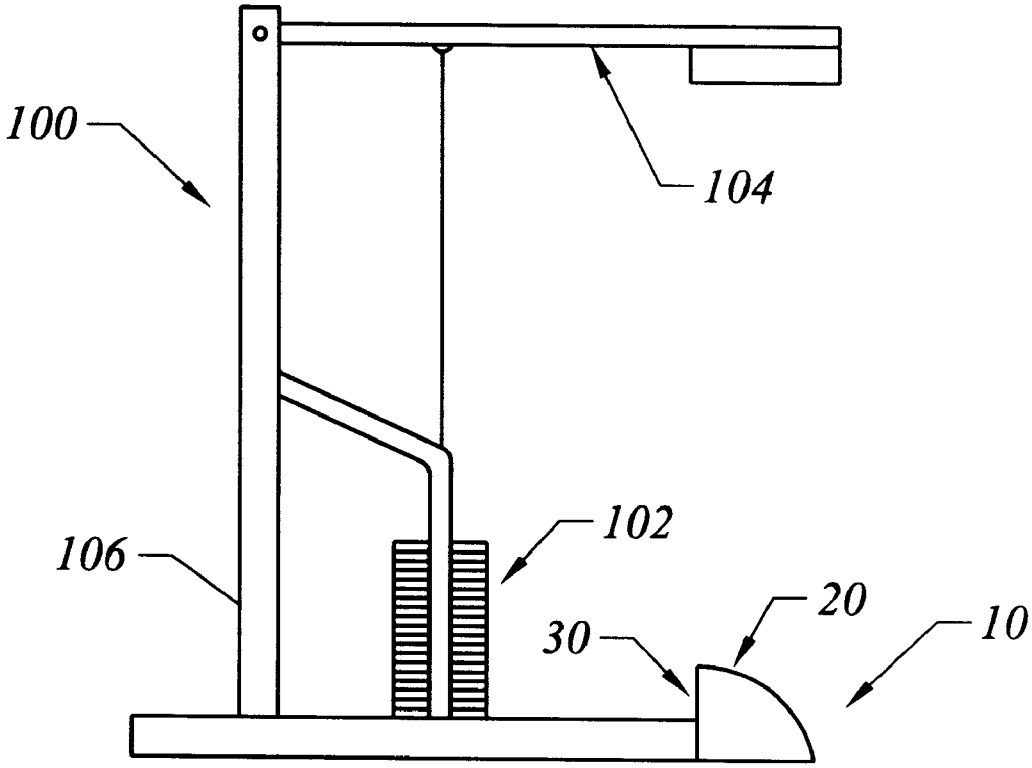
FIG. 5 is a side view of the implementation of the present invention on an machine for performing exercises.

FIG. 5 illustrates yet another embodiment of the present invention where curved foot plate 20 and support structure 30 are implemented on exercise machine 100. Machine 100 generally includes a weight stack 102 and an associated mechanism 104 to permit the user to lift the stack. Note that weight stack 102 may be implemented in other forms such as iron plates or some other load. The various components may be supported by an appropriate frame 106. While the particular machine depicted in FIG. 5 is a standing calf machine, the invention may be used in any similar machines, especially those directed at calf strengthening such as various seated leg press and donkey calf machines. By implementing the present invention on such a machine, various exercises may be performed, such as calf flexion exercises, while maintaining the calf muscles in a desired position and limiting over stretching.

It should be understood that the descriptions provided herein are meant to provide examples of preferred embodiments of the present invention and are not meant to limit the scope of the invention. One skilled in the art may provide variations or modifications without deviating from the present invention. For example, various materials may be used for constructing the various components of the present invention. Where steel or metal was described, other materials may be appropriate including high strength plastic. Thus, these and other modifications may be made without departing from the scope of the invention itself as stated in the appended claims.

We claim:

1. An apparatus for conducting flexion exercises of the gastrocnemius muscles of the leg, the apparatus including:

at least one plate for placing thereon a user's foot, and a support structure providing a base for the apparatus, wherein said at least one plate is immovably fixed to the support structure to rise said plate from a surface, such that the at least one plate is stationary while performing exercises, the at least one plate having a convex curve, wherein the convex curve has a radius of curvature of approximately 5 to 36 inches and sufficient to provide support of a foot, including toes, balls of the feet, arches and heels, and to provide for varying degrees of limitation of flexion of a user's muscles, wherein a bar mounted on the support structure extends upward to a sufficient height for a user to grasp to assist the user's balance.

2. An apparatus for conducting flexion exercises of the gastrocnemius muscles of the leg, the apparatus including:

at least one plate for placing thereon a user's foot, and a support structure providing a base for the apparatus, wherein said at least one plate is immovably fixed to the support structure to raise said plate from a surface, such that the at least one plate is stationary while performing exercises, the at least one plate having a convex curve, wherein the convex curve has a radius of curvature of approximately 5 to 36 inches and sufficient to provide support of a foot, including toes, balls of the feet, arches and heels, and to provide for varying degrees of limitation of flexion of a user's muscles, wherein the at least one plate is one continuous plate for placing thereon the user's two feet, and the support structure includes a portion extending upward a sufficient height for a user to grasp while conducting exercises.

3. An apparatus for conducting flexion exercises of the gastrocnemius muscles of the leg, the apparatus including:

at least one plate for placing thereon a user's foot, and a support structure providing a base for the apparatus, wherein said at least one plate is immovably fixed to the support structure to raise said plate from a surface, such that the at least one plate is stationary while performing exercises, the at least one plate having a convex curve, wherein the convex curve has a radius of curvature of approximately 5 to 36 inches and sufficient to provide support of a foot, including toes, balls of the feet, arches and heels, and to provide for varying degrees of limitation of flexion of a user's muscles, wherein the at least one plate is a pair plates, one each for a user's right and left feet, and the support structure includes a portion extending upward a sufficient height for a user to grasp while conducting exercises.

4. The apparatus as in claims 1, 2, or 3, wherein the at least one plate has a slip resistant surface.

5. The apparatus as in claims 1, 2, or 3, wherein markings are provided to indicate varying degrees of difficulty in performing flexion exercises.

6. The apparatus as in claims 1, 2, or 3, wherein said radius of curvature is approximately 14 to 16 inches.

7. An apparatus for conducting flexion exercises of the gastrocnemius muscles of the leg, the apparatus including:

at least one plate for placing thereon at least one foot of a user, and a support structure providing a base for the apparatus, wherein said at least one plate is immovably fixed to the support structure to raise said plate from a surface, such that the at least one plate is stationary while performing exercises, the at least one plate having a convex curve, wherein the convex curve has a radius of curvature of at least 5 inches but not more than 36 inches, wherein a bar mounted on the support structure extends upward to a sufficient height for a user to grasp to assist the user's balance.

8. An apparatus for conducting flexion exercises of the gastrocnemius muscles of the leg, the apparatus including:

at least one plate for placing thereon at least one foot of a used, and a support structure providing a base for the apparatus, wherein said at least one plate is immovably fixed to the support structure to raise said plate from a surface, such that the at least one plate is stationary while performing exercises, the at least one plate having a convex curve, wherein the convex curve has a radius of curvature of at least 5 inches but not more than 36 inches, wherein the support structure includes a portion extending upward a sufficient height for a user to grasp while conducting exercises.

9. An apparatus for conducting flexion exercises of the gastrocnemius muscles of the leg, the apparatus including:

at least one plate for placing thereon at least one foot of a user, and a support structure providing a base for the apparatus, wherein said at least one plate is immovably fixed to the support structure to raise said plate from a surface, such that the at least one plate is stationary while performing exercises, the at least one plate having a convex curve, wherein the convex curve has a radius of curvature of at least 5 inches but not more than 36 inches, wherein the at least one plate is a pair plates, one each for a user's right and left feet, and the support structure includes a portion extending upward a sufficient height for a user to grasp while conducting exercises.

10. The apparatus as in claims 7, 8, or 9, wherein the at least one plate has a slip resistant surface.

11. The apparatus as in claims 7, 8, or 9, wherein markings are provided to indicate varying degrees of difficulty in performing flexion exercises.

12. The apparatus according to claim 8 wherein said radius of curvature is approximately 14 to 16 inches.

13. The apparatus according to claim 12 wherein the radius of curvature is approximately 15.25 inches.

14. An apparatus for conducting flexion exercises of the gastrocnemius muscles of the leg, the apparatus including:

at least one plate for placing thereon a user's foot, and a support structure fixed to the at least one plate to raise said plate from a surface, such that the at least one plate is stationary while performing exercises, the at least one plate having a convex curve, wherein the convex curve has a radius of curvature of approximately 5 to 36 inches and sufficient to provide support of a foot, including toes, balls of the feet, arches and heels, and to provide for varying degrees of limitation of flexion of a user's muscles, further comprising a frame mounted on the support structure carrying a load and a mechanism permitting a user to move said load, wherein said at least one convex plate is positioned on said support structure in relationship to said mechanism to permit the user to position the feet on said plate while exercising.

15. An exercise apparatus, comprising a frame;

a weight stack mounted on the frame;

a mechanism to permit a user to lift at least a portion of the weight stack;

at least one plate having a convex curve, disposed on the frame in relationship to said mechanism such that at least one of the user's feet may be placed on said plate during exercise, wherein the convex curve has a radius of curvation sufficient to provide support of a foot, including toes, balls of the feet, arches and heels, and to provide for varying degrees of limitation of flexion of a user's muscle.

16. The apparatus as in claim 15, wherein the exercise equipment is for performing squat exercises.

17. The apparatus as in claim 15, wherein the exercise equipment is for performing calf strengthening exercises.

18. The apparatus as in claim 15, wherein the at least one plate is one continuous plate of sufficient size to receive the user's two feet.

19. The apparatus as in claim 15, wherein the at least one plate is a pair (sic) plates, one each for a user's right and left feet.

20. The apparatus as in claim 15, wherein markings are provided to indicate varying degrees of difficulty in performing flexion exercises.

* * * * *